US006705956B1

(12) United States Patent
Moriyama et al.

(10) Patent No.: US 6,705,956 B1
(45) Date of Patent: Mar. 16, 2004

(54) FOUR-PIECE SOLID GOLF BALL

(75) Inventors: Keiji Moriyama, Akashi (JP); Kazunari Yoshida, Kasai (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 221 days.

(21) Appl. No.: 09/472,893

(22) Filed: Dec. 28, 1999

(30) Foreign Application Priority Data

Dec. 28, 1998 (JP) ..... 10-372786
Sep. 28, 1999 (JP) ..... 11-274237

(51) Int. Cl.[7] ..... A63B 37/04; A63B 37/06; A63B 37/00

(52) U.S. Cl. ..... 473/371; 473/351

(58) Field of Search ..... 473/351, 370, 473/371, 373, 374, 376, 377

(56) References Cited

U.S. PATENT DOCUMENTS 5,725,442 A 3/1998 Higuchi et al.
5,733,205 A 3/1998 Higuchi et al.
5,743,816 A 4/1998 Ohsumi et al.
5,772,531 A 6/1998 Ohsumi et al.
5,779,563 A * 7/1998 Yamagishi et al. ..... 473/371
5,816,937 A 10/1998 Shimosaka et al.
6,056,650 A * 5/2000 Yamagishi et al. ..... 473/384
6,117,025 A * 9/2000 Sullivan ..... 473/373
6,123,630 A * 9/2000 Hayashi et al. ..... 473/376
6,126,558 A * 10/2000 Higuchi et al. ..... 473/374

FOREIGN PATENT DOCUMENTS

| | | |
|---|---|---|
| JP | A8-336618 | 12/1996 |
| JP | A9-56848 | 3/1997 |
| JP | A9-248351 | 9/1997 |
| JP | A9-266959 | 10/1997 |
| JP | A10-127818 | 5/1998 |
| JP | A10-127819 | 5/1998 |

* cited by examiner

*Primary Examiner*—Mark S. Graham
*Assistant Examiner*—Alvin A. Hunter, Jr.
(74) *Attorney, Agent, or Firm*—Birch, Stewart, Kolasch & Birch LLP

(57) ABSTRACT

The present invention provides a four-piece solid golf ball having excellent flight performance and good shot feel at the time of hitting. The present invention relates to a four-piece solid golf ball comprising a core, an intermediate layer formed on the core, an outer layer formed on the intermediate layer and a cover covering the outer layer, wherein the core has a surface hardness in JIS-C hardness of 67 to 85, a JIS-C hardness of the intermediate layer is higher than the surface hardness of the core, and a JIS-C hardness of the outer layer is higher than the hardness of the intermediate layer.

4 Claims, 3 Drawing Sheets

FOUR-PIECE SOLID GOLF BALL

FIELD OF THE INVENTION

The present invention relates to a four-piece solid golf ball having excellent flight performance and good shot feel at the time of hitting. More particularly, it relates to a four-piece solid golf ball having high launch angle.

BACKGROUND OF THE INVENTION

Many types of golf balls are commercially selling, but they are typically classified into thread wound golf balls and solid golf balls. The solid golf balls which are mainly commercially selling are two-piece golf balls, which consists of a solid core of molded rubber material and a cover of thermoplastic resin (e.g. ionomer resin) covering on the solid core. The two-piece solid golf ball has such a simple structure, but has long flight performance and good durability. The two-piece solid golf ball is generally approved or employed by many golfers, especially amateur golfers. On the other hand, it is problem that the two-piece solid golf ball has hard and poor shot feel at the time of hitting.

In order to solve the problem, various golf balls such as a three-piece solid golf ball comprising two-layer core or two-layer cover, a four-piece solid golf ball comprising two-layer core and two-layer cover, three-layer core or three-layer cover and the like have been proposed (Japanese Patent Kokai Publication Nos. 336618/1996, 56848/1997, 248351/1997, 266959/1997, 127818/1998, 127819/1998 and the like).

Japanese Patent Kokai Publication Nos. 336618/1996 and 56848/1997 suggest a multi-piece solid golf ball having at least four layers, which comprises a core having at least two layers, and a two-layer cover composed of an inner cover and outer cover. However, in the both golf balls, one of the two-layer cover is made harder and therefore the resulting golf ball has poor shot feel.

Japanese Patent Kokai Publication No. 248351/1997 suggests a multi-piece solid golf ball having at least four layers, which comprises a core, and a cover having at least three layers composed of an inmost layer cover, at least one layer of intermediate layer cover, and an outmost layer cover. However, since one of the intermediate layers is made harder than the inmost layer cover and outmost layer cover, that is, the intermediate layer cover is harder than the outmost layer cover, the shot feel of the resulting golf ball is poor as described in the above.

Japanese Patent Kokai Publication Nos. 266959/1997, 127818/1998 and 127819/1998 suggest a four-piece solid golf ball which comprises a cover and a three-layer core composed of an inner layer, an intermediate layer and an outer layer. However, since the golf balls do not have a structure that an outer portion is harder and an inner portion is softer, the golf ball is not effectively deformed and a launch angle is small, which reduces a flight distance.

These multi-piece golf balls, when compared with the two-piece golf ball, have better shot feel while maintaining excellent flight performance, because the golf balls can have a various of hardness distribution. However, the golf balls, when compared with the thread wound golf ball, have hard and poor shot feel when hitting by a driver or an iron club at a low head speed.

OBJECTS OF THE INVENTION

A main object of the present invention is to provide a four-piece solid golf ball having long flight distance by accomplishing high launch angle and low spin amount at the time of hitting, while maintaining good shot feel when hitting by a driver and an iron club at a low head speed.

According to the present invention, the object described above has been accomplished by employing a four-layer structure which comprises a core, an intermediate layer, an outer layer and a cover to form a four-piece solid golf ball, and adjusting a surface hardness of the core, and a hardness difference between the surface of the core and the intermediate layer and a hardness difference between the intermediate layer and the outer layer to specified ranges. The present invention thus provides a four-piece solid golf ball having long flight distance by accomplishing high launch angle, while maintaining good shot feel when hitting by a driver and an iron club at a low head speed. In other words, a deformation amount of the golf ball on impact can be optimized and energy loss because of large deformation amount of the golf ball can be restrained by adjusting hardness distribution of the golf ball so as to increase the hardness from the center point to surface of the golf ball in order, thereby providing a four-piece solid golf ball having excellent flight performance by accomplishing high launch angle when hitting by a driver and an iron club.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustrating only, and thus are not limitative of the present invention, and wherein.

SUMMARY OF THE INVENTION

The present invention provides a four-piece solid golf ball comprising a core, an intermediate layer formed on the core, an outer layer formed on the intermediate layer and a cover covering the outer layer, wherein the core has a surface hardness in JIS-C hardness of 67 to 85, a JIS-C hardness of the intermediate layer is higher than the surface hardness of the core, and a JIS-C hardness of the outer layer is higher than the hardness of the intermediate layer.

In order to suitably practice the present invention, it is desired that the intermediate layer has a JIS-C hardness of 80 to 95 and the outer layer has a JIS-C hardness of 85 to 100, a subtraction of the JIS-C hardness of the cover from that of the outer layer is from −10 to 5, the JIS-C hardness of the outer layer is the same as that of the cover, a specific gravity of the outer layer is different from that of the cover, the specific gravity of the outer layer is higher than that of the outer layer by more than 0.1.

DETAILED DESCRIPTION OF THE INVENTION

Figure 1:
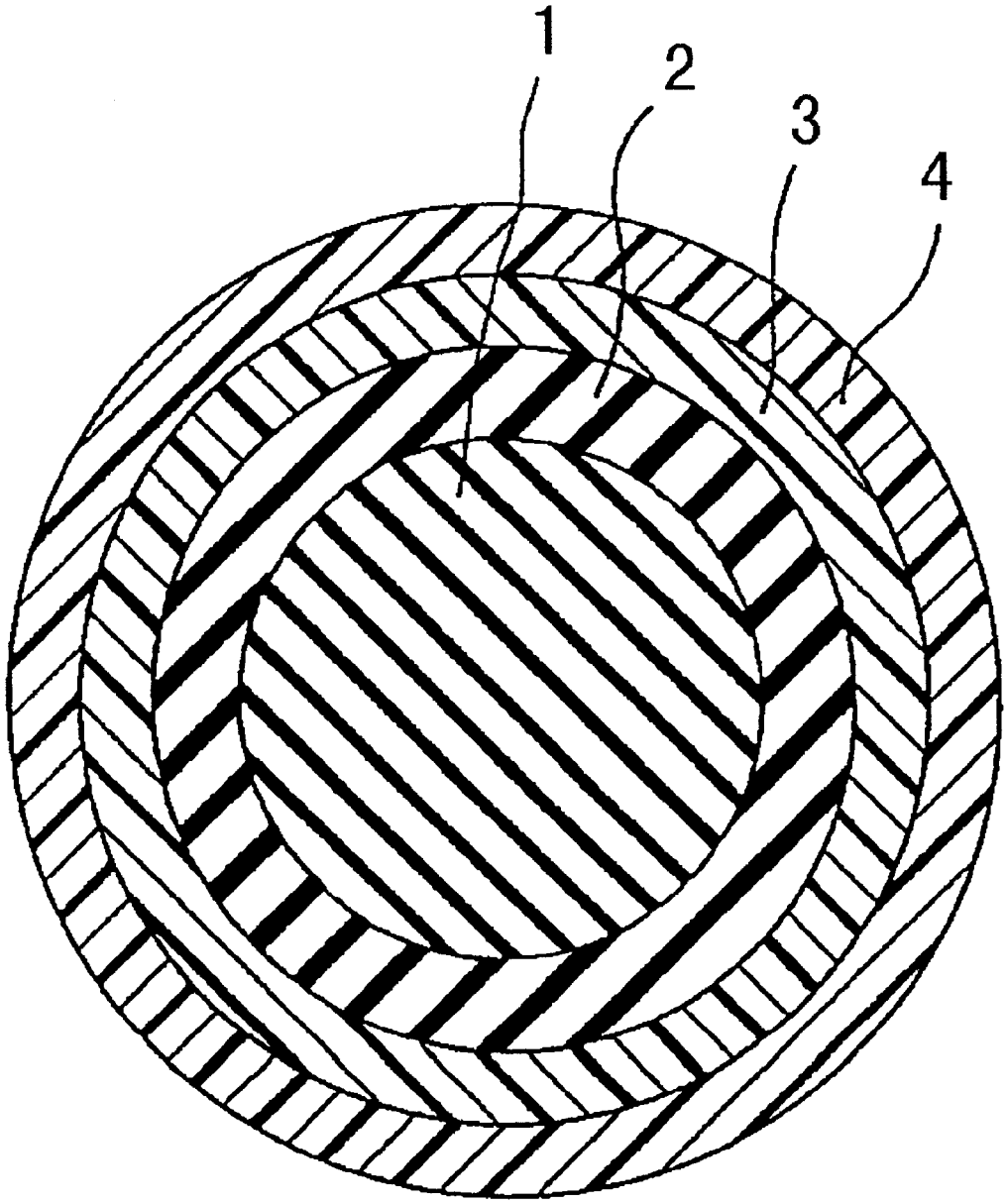
FIG. 1 is a schematic cross section illustrating one embodiment of the golf ball of the present invention.

The four-piece solid golf ball of the present invention will be explained with reference to the accompanying drawings in detail. FIG. 1 is a schematic cross section illustrating one embodiment of the four-piece solid golf ball of the present invention. As shown in FIG. 1, the golf ball of the present invention comprises a core 1 and an intermediate layer 2 formed on the core 1, an outer layer 3 covering the intermediate layer 2, and a cover 4 covering the outer layer 3.

The core 1 used for the golf ball of the present invention is formed to have a surface hardness in JIS-C hardness of 67 to 85, preferably 67 to 80, more preferably 70 to 75. When the surface hardness of the core 1 is smaller than 67, the core is too soft, and the deformation amount of the resulting golf ball is large, the rebound characteristics are degraded, which reduces a flight distance. On the other hand, when the surface hardness of the core 1 is larger than 85, the core is too hard, and the shot feel of the resulting golf ball is hard and poor. In addition, the deformation efficiency at the time of hitting of the golf ball is degraded (that is, it is difficult to deform the golf ball), and the launch angle is small, which reduces a flight distance. It is preferable that the surface hardness of the core 1 is higher than the center hardness thereof. The center hardness in JIS-C hardness of the core 1 is 50 to 80, preferably 54 to 72. A difference between the center hardness and surface hardness is 0 to 15, preferably 5 to 13. The surface hardness of the core as used herein is determined by measuring a hardness at the surface of the core, after removing the cover 4, outer layer 3 and intermediate layer 2 from the resulting golf ball to expose the core 1. The center hardness of the core as used herein is determined by cutting the core into two equal parts and then measuring a JIS-C hardness at the center point of the section.

The core 1 has a specific gravity of 1.1 to 1.4, preferably 1.1 to 1.3. When the specific gravity is smaller than 1.1, the weight of the golf ball is too light, and the golf ball is affected by wind, which widely varies flight distance. On the other hand, when the specific gravity is larger than 1.4, the weight of the golf ball is too heavy, and the golf ball does not meet the R & A Standard.

The core 1 is obtained by vulcanizing or press-molding a rubber composition. The rubber composition typically comprises a base rubber, a co-crosslinking agent, an organic peroxide, a filler and the like. The base rubber used in the present invention may be natural rubber and/or synthetic rubber, which have been conventionally used for solid golf balls. Preferred is high-cis polybutadiene rubber containing not less than 40%, preferably not less than 80% of a cis-1,4 bond. The high-cis polybutadiene rubber may be mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). The preferred co-crosslinking agent is zinc acrylate because it imparts high rebound characteristics to the resulting golf ball. A metal salt of α,β-unsaturated carboxylic acid obtained by reacting α,β-unsaturated carboxylic acid with a metal oxide, such as zinc oxide, when mixing the rubber composition may be used. The amount of the co-crosslinking agent in the rubber composition is from 10 to 35 parts by weight, preferably from 28 to 30 parts by weight, based on 100 parts by weight of the base rubber. When the amount of the co-crosslinking agent is smaller than 10 parts by weight, the core is too soft, and the rebound characteristics are degraded, which reduces flight distance. On the other hand, when the amount of the co-crosslinking agent is larger than 35 parts by weight, the core is too hard, and the shot feel is hard and poor.

The organic peroxide, which acts as a crosslinking agent or curing agent, includes, for example, dicumyl peroxide, 1,1-bis(t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.3 to 3.0 parts by weight, preferably 0.5 to 1.5 parts by weight, based on 100 parts by weight of the base rubber. When the amount of the organic peroxide is smaller than 0.3 parts by weight, the core is too soft, and the rebound characteristics are degraded, which reduces flight distance. On the other hand, when the amount of the organic peroxide is larger than 3.0 parts by weight, the core is too hard, and the shot feel is poor.

The filler used for the core 1 of the present invention, which can be typically used for the core of golf ball, includes for example, inorganic filler (such as zinc oxide, barium sulfate, calcium carbonate and the like), high specific gravity metal powder filler (such as tungsten powder, molybdenum powder and the like), and the mixture thereof. The amount of the filler is from 3 to 50 parts by weight, preferably from 5 to 40 parts by weight, based on 100 parts by weight of the base rubber. When the amount of the filler is smaller than 3 parts by weight, the core is too light, and thus the resulting golf ball is too light. On the other hand, when the amount of the filler is larger than 50 parts by weight, the core is too heavy, and the resulting golf ball is too heavy.

The rubber composition for the core 1 of the golf ball of the present invention can contain other components, which have been conventionally used for preparing the core of solid golf balls, such as antioxidant or peptizing agent. If used, an amount of the antioxidant is preferably 0.2 to 1.5 parts by weight, based on 100 parts by weight of the base rubber. The intermediate layer 2 is then formed on the core 1.

It is required that the intermediate layer 2 has higher JIS-C hardness than the surface hardness of the core 1. Thereby the portion from the core 1 to the intermediate layer 2 has a structure that the outer portion is harder and the inner portion is softer, and the golf ball can be effectively deformed at the time of hitting and the launch angle is large. When the hardness of the intermediate layer 2 is not more than the surface hardness of the core 1, the golf ball does not deforms at all portion thereof, but it deforms only at a portion thereof. Therefore, the restoring force is small and the launch angle is small, which reduces flight distance. It is desired that the intermediate layer 2 have a JIS-C hardness of 80 to 95, preferably 80 to 90, more preferably 80 to 88. When the hardness is smaller than 80, the portion from the core 1 to the intermediate layer 2 is too soft and has large deformation amount, the durability is degraded. On the other hand, when the hardness is larger than 95, the golf ball can not be effectively deformed at the time of hitting and the launch angle is small.

It is desired that the intermediate layer 2 of the golf ball of the present invention have a thickness of 1.0 to 4.0 mm, preferably 1.0 to 2.5 mm. When the thickness is smaller than 1.0 mm, the rebound characteristics are degraded. On the other hand, when the thickness is larger than 4.0 mm, the shot feel is hard and poor. It is desired that the hardness difference in JIS-C hardness between the intermediate layer 2 and the surface of the core 1 is 5 to 28, preferably 5 to 20. When the hardness difference is smaller than 5, the deformation of the golf ball is restrained, and the launch angle is small. On the other hand, when the hardness difference is larger than 28, the restoring force when deforming the golf ball is small, and the rebound characteristics are degraded.

The hardness of the intermediate layer as used herein is determined by measuring a hardness at the surface of the molded article, after removing the cover 4 and the outer layer 3 from the resulting golf ball to expose the molded article having the structure covering the core 1 with the intermediate layer 2.

The intermediate layer 2 has a specific gravity of 1.1 to 1.4, preferably 1.1 to 1.3. When the specific gravity is smaller than 1.1, the weight of the golf ball is too light, and the golf ball is affected by wind, which widely varies flight distance. On the other hand, when the specific gravity is larger than 1.4, the weight of the golf ball is too heavy, and the golf ball does not meet the R & A Standard.

The material suitably used for the intermediate layer 2 of the present invention is not specifically limited as long as the resulting intermediate layer has a desired hardness, but may include the vulcanized molded article of the rubber composition that is the same as used for the core 1, or thermoplastic resin, such as ionomer resin, thermoplastic elastomer, diene block copolymer or mixture thereof, depending on the hardness.

The ionomer resin may be a copolymer of ethylene and α,β-unsaturated carboxylic acid having 3 to 8 carbon atoms, of which a portion of carboxylic acid groups is neutralized with metal ion, or a terpolymer of ethylene, α,β-unsaturated carboxylic acid and α,β-unsaturated carboxylic acid ester, of which a portion of carboxylic acid groups is neutralized with metal ion. Examples of the α,β-unsaturated carboxylic acid in the ionomer include acrylic acid, methacrylic acid, fumaric acid, maleic acid, crotonic acid and the like, preferred are acrylic acid and methacrylic acid. Examples of the α,β-unsaturated carboxylic acid ester in the ionomer include methyl ester, ethyl ester, propyl ester, n-butyl ester and isobutyl ester of acrylic acid, methacrylic acid, fumaric acid, maleic acid and the like. Preferred are acrylic acid esters and methacrylic acid esters. The metal ion which neutralizes a portion of carboxylic acid groups of the copolymer or terpolymer includes a sodium ion, a potassium ion, a lithium ion, a magnesium ion, a calcium ion, a zinc ion, a barium ion, an aluminum, a tin ion, a zirconium ion, cadmium ion, and the like. Preferred are sodium ions, zinc ions, magnesium ions and the like, in view of rebound characteristics, durability and the like. The ionomer resin is not limited, but examples thereof will be shown by a trade name thereof. Examples of the ionomer resins, which are commercially available from Mitsui Du Pont Polychemical Co., Ltd. include Hi-milan 1555, Hi-milan 1557, Hi-milan 1605, Hi-milan 1652, Hi-milan 1702, Hi-milan 1705, Hi-milan 1706, Hi-milan 1707, Hi-milan 1855, Hi-milan 1856 and the like. Examples of the ionomer resins, which are commercially available from Du Pont Co., include Surlyn 8945, Surlyn 9945, Surlyn AD8511, Surlyn AD8512, Surlyn AD8542 and the like. Examples of the ionomer resins, which are commercially available from Exxon Chemical Co., include Iotek 7010, Iotek 8000 and the like. These ionomer resins may be used alone or in combination.

Examples of the thermoplastic elastomers include polyamide thermoplastic elastomer, which is commercially available from Toray Co., Ltd. under the trade name of "Pebax" (such as "Pebax 2533S"); polyester thermoplastic elastomer, which is commercially available from Toray-Du Pont Co., Ltd. under the trade name of "Hytrel" (such as "Hytrel 3548", "Hytrel 4047"); polyurethane elastomer, which is commercially available from Takeda Verdishe Co., Ltd. under the trade name of "Elastoran" (such as "Elastoran ET880"); and the like.

The diene block copolymer is a block copolymer or partially hydrogenated block copolymer having double bond derived from conjugated diene compound. The base bock copolymer is block copolymer composed of block polymer block A mainly comprising at least one aromatic vinyl compound and polymer block B mainly comprising at least one conjugated diene compound. The partially hydrogenated block copolymer is obtained by hydrogenating the block copolymer. Examples of the aromatic vinyl compounds comprising the block copolymer include styrene, α-methyl styrene, vinyl toluene, p-t-butyl styrene, 1,1-diphenyl styrene and the like, or mixtures thereof. Preferred is styrene. Examples of the conjugated diene compounds include butadiene, isoprene, 1,3-pentadiene, 2,3-dimethyl-1,3-butadiene and the like, or mixtures thereof. Preferred are butadiene, isoprene and combinations thereof. Examples of the diene block copolymers which are commercially available include the diene block copolymers, which are commercially available from Daicel Chemical Industries, Ltd. under the trade name of "Epofriend" (such as "Epofriend A1010"), the diene block copolymers, which are commercially available from Kuraray Co., Ltd. under the trade name of "Septon" (such as "Septon HG-252") and the like.

The composition for the intermediate layer 2 used in the present invention may optionally contain fillers and the like, in addition to the resin component as main component. Examples of fillers are not limited as long as they have been conventionally used for the core of golf balls, but include inorganic filler (such as zinc oxide, barium sulfate, calcium carbonate and the like), high specific gravity metal powder filler (such as tungsten powder, molybdenum powder and the like), and the mixture thereof.

A method of forming the intermediate layer 2 when using the vulcanized molded article of the rubber composition for the intermediate layer 2 will be explained with reference to the accompanying drawing in detail.

Figure 2:
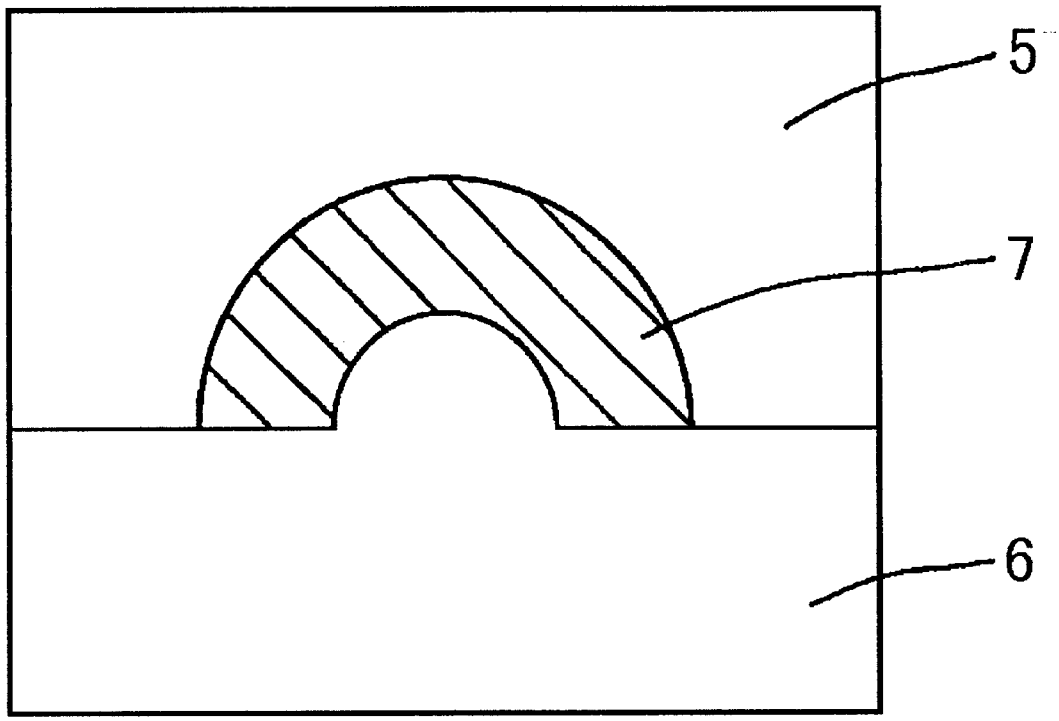
FIG. 2 is a schematic cross section illustrating one embodiment of a mold for producing a semi-spherical half shell for the intermediate layer or outer layer of the golf ball of the present invention.
Figure 3:
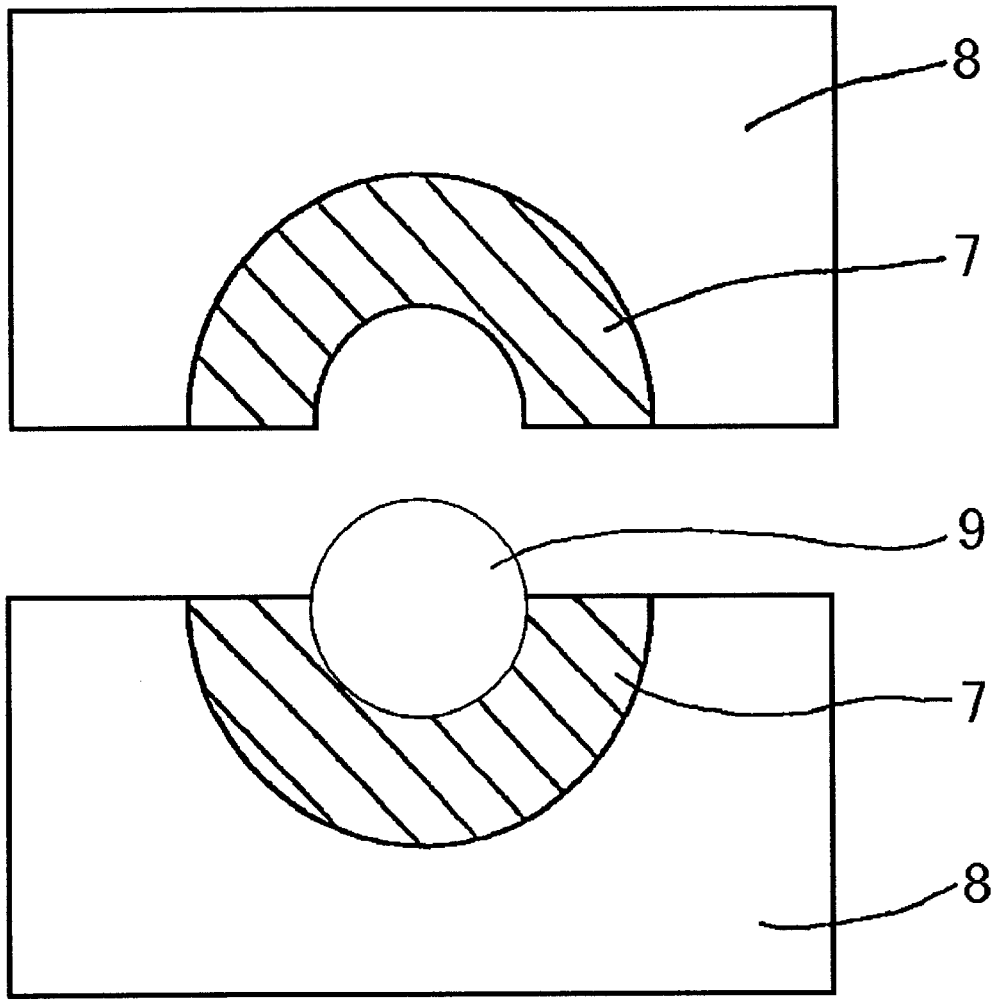
FIG. 3 is a schematic cross section illustrating one embodiment of another mold for producing a spherical molded article obtained by covering the intermediate layer or outer layer of the golf ball of the present invention.

FIG. 2 is a schematic cross section illustrating one embodiment of the mold for producing a semi-spherical half shell for the intermediate layer of the golf ball of the present invention. FIG. 3 is a schematic cross section illustrating one embodiment of the mold for producing a spherical molded article obtained by covering the core with the intermediate layer of the golf ball of the present invention. The rubber compositions for the intermediate layer is press-molded at 140 to 150° C. for 3 to 10 minutes in a mold having a semi-spherical cavity 5 and a male plug mold 6 having a semi-spherical convex having the same shape as the core as described in FIG. 2 to obtain a semi-vulcanized semi-spherical half-shell 7 for the intermediate layer. The core 9 is covered with the two semi-vulcanized semi-spherical half-shells 7 for the intermediate layer, and then vulcanized by integrally press-molding at 140 to 170° C. for 10 to 40 minutes in a mold 8 described in FIG. 3 to form the intermediate layer 2 on the core 1.

A method of forming the intermediate layer 2 when using the thermoplastic resin for the intermediate layer 2 is not specifically limited, but may be a well-known method, which has been conventionally used for forming golf ball cover. For example, there can be used a method comprising molding the intermediate layer composition into a semi-spherical half-shell, covering the core with the two half-shells, followed by pressure molding at 130 to 170° C. for 1 to 5 minutes, or a method comprising injection molding the intermediate layer composition directly on the core to cover it. The outer layer 3 is then covered on the intermediate layer 2.

It is required that the outer layer 3 used for the golf ball of the present invention is formed so as to have a JIS-C hardness which is higher than the hardness of the intermediate layer 2. Thereby the portion from the core 1 to the outer layer 3 has a structure that the outer portion is harder and the inner portion is softer, and the golf ball can be effectively deformed at the time of hitting and the launch angle is large. When the hardness of the outer layer 3 is less than that of the intermediate layer 2, the golf ball has distortion in deformation and therefore deforms partially. The restoring force is small and the launch angle is small, which reduces flight distance. It is desired that the outer layer 3 have a JIS-C hardness of 85 to 100, preferably 88 to 100, more preferably 95 to 100. When the hardness is smaller than 85, the outer layer 3 is too soft, and the rebound characteristics are degraded. It is desired that the hardness difference between the outer layer 3 and the intermediate layer 2 is 5 to 20, preferably 5 to 15. When the hardness difference is smaller than 5, it is difficult to deform the resulting golf ball, and the launch angle too small. On the other hand, when the hardness difference is larger than 20, the deforming amount is too large, and the restoring force is small, which reduces the rebound characteristics, and the durability is degraded. The hardness of the outer layer 3 as used herein is determined by measuring a hardness at the surface of the molded article, after removing the cover from the resulting golf ball to expose a molded article which is the core covering with the intermediate layer and outer layer.

The outer layer 3 has a specific gravity of 1.1 to 1.5, preferably 1.2 to 1.4. When the specific gravity is smaller than 1.1, the moment of inertia of the resulting golf ball is too small, and it is difficult to maintain the spin amount, which reduces flight distance. On the other hand, when the specific gravity is larger than 1.5., the amount of the filler is too large, and the rebound characteristics are degraded. It is desired that the specific gravity of the outer layer 3 is larger than that of the core 1 and that of the intermediate layer 2. It is desired that a difference of the specific gravity be 0.05 to 0.2, preferably 0.05 to 0.15. When the difference of the specific gravity is smaller than 0.05, the technical effect of an extension of flight distance accomplished by increasing the moment of inertia to maintain the spin amount can not be sufficiently obtained. On the other hand, when the specific gravity is larger than 0.2, the amount of the filler in the composition for the outer layer is too large, and the rebound characteristics of the resulting golf ball are degraded.

The outer layer 3 has a thickness of 1.0 to 2.5 mm, preferably 1.5 to 2.0 mm. When the thickness is smaller than 1.0 mm, the rebound characteristics are degraded. On the other hand, when the thickness is larger than 2.5 mm, the shot feel is hard and poor.

The material used for the outer layer 3 of the present invention is not specifically limited as long as the resulting outer layer has the hardness described above, but includes the material that is the same as used for the intermediate layer 2, which may be a vulcanized molded article of a rubber composition or a thermoplastic resin, such as ionomer resin, thermoplastic elastomer, diene block copolymer or mixture thereof, depending on the hardness.

The composition for the outer layer 3 used for the golf ball of the present invention may contain fillers for adjusting the specific gravity thereof, in addition to the resin component contained therein as main component. Examples of fillers are not limited as long as they have been conventionally used for the core of golf balls, but include inorganic filler (such as zinc oxide, barium sulfate, calcium carbonate and the like), high specific gravity metal powder filler (such as tungsten powder, molybdenum powder and the like), and the mixture thereof.

A method of forming the outer layer 3 on the intermediate layer 2 when using the vulcanized molded article of the rubber composition for the outer layer 3 is the same method as used in the intermediate layer 2, except for using the spherical molded article obtained by covering the core with the intermediate layer in place of the core 1, and using a mold having a semi-spherical cavity 5 and a male plug mold 6 having a semi-spherical convex having the same diameter as the spherical molded article as described in FIG. 2. A method of forming the outer layer 3 when using the thermoplastic resin for the outer layer 3 is also the same method as used in the intermediate layer 2. The cover 4 is then covered on the outer layer 3.

When the hardness difference between the cover 4 used for the golf ball of the present invention from the outer layer 3 is large, the strain between the outer layer 3 which has large deformation amount at the time of deforming the golf ball and cover 4 is large, and the rebound characteristics are degraded. Therefore it is desired that a subtraction of the JIS-C hardness of the cover from that of the outer layer is from −10 to 5, preferably −3 to 0. When the subtraction is smaller than −10, the durability is degraded, in addition to the degradation of the rebound characteristics. On the other hand, when the subtraction is larger than 5, the launch angle is small, which reduces flight distance, in addition to the degradation of the rebound characteristics. Moreover, it is desired that the subtraction be made 0, that is, the cover 4 has the same JIS-C hardness as the outer layer 3. Thereby the layer having the highest hardness can be made thick and placed at an outer portion of the golf ball, and the shot feel is light and good.

In the golf ball of the present invention, it is desired that a difference of the JIS-C hardness of the intermediate layer 2 from that of the cover 4 is from 5 to 20, preferably 5 to 15. When the hardness difference is smaller than 5, it is difficult to deform the golf ball, and the launch angle is small, which reduces flight distance. On the other hand, when the hardness difference is larger than 20, the deformation amount of the golf ball is too large, and the durability is degraded.

In the golf ball of the present invention, it is desired that cover 4 have a JIS-C hardness of 85 to 100, preferably 88 to 100, more preferably 95 to 100. When the hardness is smaller than 85, the rebound characteristics are degraded, which reduces flight distance. The hardness of the cover 4 as used herein is determined by measuring a JIS-C hardness at the surface of the molded article, after the molded article is obtained by covering the core with the intermediate layer, outer layer and cover.

It is desired that the specific gravity of the outer layer 3 is different from that of the cover 4, and the specific gravity of the outer layer 3 is higher than that of the cover 4 by more than 0.1, preferably the difference of the specific gravity of the cover 4 from that of the outer layer 3. is 0.1 to 0.3, more preferably the difference of the specific gravity is 0.2 to 0.3. When the difference of the specific gravity is smaller than 0.1, the technical effect of extending the flight distance accomplished by increasing the moment of inertia to enlarge the retention of the spin amount can not be sufficiently obtained. On the other hand, when the difference of the specific gravity is larger than 0.3, the amount of the filler in the composition for the outer layer is too large, and the rebound characteristics of the resulting golf ball are degraded. In order to obtain the technical effect of extending the flight distance accomplished by increasing the moment of inertia to enlarge the retention of the spin amount, the specific gravity of the layer nearby the surface of the golf ball is enlarged by forming the cover layer 4 so that the specific gravity of the outer layer 3 is higher than that of the cover 4. The technical effect can be obtained by heightening the specific gravity of the cover, but the amount of the filler in the resin composition for the cover is too large, and the rebound characteristics of the cover, which have serious affection on those of the resulting golf ball, are degraded. In order to avoid the degradation of the rebound characteristics, the specific gravity can be effectively heightened by using high specific gravity filler such as tungsten powder as a filler, but the appearance of the golf ball (particularly whiteness) is degraded. It is desired that the cover 4 have a specific gravity of 0.9 to 1.0.

The cover 4 has a thickness of 1.0 to 2.5 mm, preferably 1.5 to 2.0 mm. When the thickness is smaller than 1.0 mm, the rebound characteristics are degraded. On the other hand, when the thickness is larger than 2.5 mm, the shot feel is hard and poor.

The material can be used for the cover 4 of the present invention is not specifically limited as long as the resulting cover has the hardness described above, but includes the material that is the same as used for the intermediate layer 2, which may be the vulcanized molded article of the rubber composition or the thermoplastic resin, such as ionomer resin, thermoplastic elastomer, diene block copolymer or mixture thereof, depending on the hardness.

The composition for the cover 4 used for the golf ball of the present invention may contain fillers for adjusting the specific gravity thereof, in addition to the resin component as main component. Examples of fillers are not limited, but include inorganic filler (such as zinc oxide, barium sulfate, calcium carbonate and the like) and mixtures thereof.

The composition for the cover used in the present invention may optionally contain pigments (such as titanium dioxide, etc.), and other additives such as a UV absorber, a photostabilizer and a fluorescent agent or a fluorescent brightener, etc., in addition to the resin component, as long as the addition of the additives does not deteriorate the desired performance of the cover of the golf ball. The amount of the pigment is preferably 0.1 to 5.0 parts by weight, based on 100 parts by weight of the resin component for the cover.

The cover used in the present invention is formed by a conventional method for forming golf ball cover well known in the art, such as injection molding, press-molding and the like. At the time of molding the cover, many depressions called "dimples" may be optionally formed on the surface of the golf ball. Furthermore, paint finishing or marking with a stamp may be optionally provided after the cover is molded for commercial purpose.

EXAMPLES

The following Examples and Comparative Examples further illustrate the present invention in detail but are not to be construed to limit the scope of the present invention.

Examples 1 to 12 and Comparative Examples 1 to 5

Production of Core

The rubber compositions for the core having the formulation shown in Tables 1 and 2 (Examples) and Table 3 (Comparative Examples) were mixed by a mixing roll, and then vulcanized by press-molding at 160° C. for 25 minutes to obtain spherical cores. The diameter, JIS-C hardness and specific gravity of the resulting cores were measured. The results are shown in Tables 7 and 8 (Examples) and Table 9 (Comparative Examples). The test methods are described later.

Formation of Intermediate Layer (a) Examples 1 to 4 and 6 to 12, and Comparative Examples 1 to 5

The compositions for the intermediate layer having the formulation shown in Tables 1 and 2 (Examples) and Table 3 (Comparative Examples) were injection molded on the core to form the intermediate layer. The thickness, JIS-C hardness and specific gravity of the intermediate layer were measured. The results are shown in Tables 7 and 8 (Examples) and Table 9 (Comparative Examples).

(b) Example 5

The rubber compositions for the intermediate layer having the formulation shown in Table 1 was mixed by a mixing roll, and then press-molded at 140° C. for 5 minutes in a mold having a semi-spherical cavity 5 and a male plug mold 6 having a semi-spherical convex having the same shape as the core as described in FIG. 2 to obtain a semi-vulcanized semi-spherical half-shell 7 for the intermediate layer. The core 9 is covered with the two semi-vulcanized semi-spherical half-shells 7 for the intermediate layer, and then vulcanized by integrally press-molding at 160° C. for 10 minutes in a mold 8 described in FIG. 3 to form the intermediate layer on the core. The thickness, JIS-C hardness and specific gravity of the intermediate layer were measured. The results are shown in Table 7.

TABLE 1

(parts by weight)

| | Example No. | | | | | |
|---|---|---|---|---|---|---|
| | 1 | 2 | 3 | 4 | 5 | 6 |
| Core composition | | | | | | |
| BR-11 *1 | 100 | 100 | 100 | 100 | 100 | 100 |
| Zinc acrylate | 21 | 23 | 27 | 30.5 | 27 | 27 |
| Zinc oxide | 9.58 | 8.82 | 7.30 | 5.96 | 7.30 | 5.82 |
| Barium sulfate | 10 | 10 | 10 | 10 | 10 | 10 |
| Dicumyl peroxide | 0.6 | 0.6 | 0.6 | 0.6 | 0.6 | 0.6 |
| Diphenyl disulfide | 1.0 | 1.0 | 1.0 | 1.0 | 1.0 | 1.0 |
| Intermediate layer composition | | | | | | |
| BR-11 *1 | — | — | — | — | 100 | — |
| Zinc acrylate | — | — | — | — | 34 | — |
| Zinc oxide | — | — | — | — | 13.2 | — |
| Dicumyl peroxide | — | — | — | — | 10 | — |
| Surlyn 8945 *2 | 47 | 40 | 36 | 36 | — | 30 |
| Surlyn 9945 *3 | 47 | 40 | 36 | 36 | — | 30 |
| Septon HG-252 *4 | 6 | 20 | 28 | 28 | — | 40 |
| Tungsten | 21.4 | 22.3 | 22.9 | 22.9 | — | 22.6 |

TABLE 2

(parts by weight)

| | Example No. | | | | | |
|---|---|---|---|---|---|---|
| | 7 | 8 | 9 | 10 | 11 | 12 |
| Core composition | | | | | | |
| BR-11 *1 | 100 | 100 | 100 | 100 | 100 | 100 |
| Zinc acrylate | 27 | 30.5 | 23 | 23 | 23 | 23 |
| Zinc oxide | 22.2 | 21.08 | 21.63 | 8.82 | 8.82 | 8.82 |
| Barium sulfate | 10 | 10 | 10 | 10 | 10 | 10 |

TABLE 2-continued (parts by weight)

| | Example No. | | | | | |
|---|---|---|---|---|---|---|
| | 7 | 8 | 9 | 10 | 11 | 12 |
| Dicumyl peroxide | 0.6 | 0.6 | 0.6 | 0.6 | 0.6 | 0.6 |
| Diphenyl disulfide | 1.0 | 1.0 | 1.0 | 1.0 | 1.0 | 1.0 |
| Intermediate layer composition | | | | | | |
| Surlyn 8945 *2 | 36 | 36 | 40 | 40 | 40 | 40 |
| Surlyn 9945 *3 | 36 | 36 | 40 | 40 | 40 | 40 |
| Septon HG-252 *4 | 28 | 28 | 20 | 20 | 20 | 20 |
| Tungsten | 33.3 | 33.3 | 27.0 | 22.3 | 22.3 | 22.3 |

TABLE 3

(parts by weight)

| | Comparative Example No. | | | | |
|---|---|---|---|---|---|
| | 1 | 2 | 3 | 4 | 5 |
| Core composition | | | | | |
| BR-11 *1 | 100 | 100 | 100 | 100 | 100 |
| Zinc acrylate | 16 | 23 | 23 | 16 | 12 |
| Zinc oxide | 11.49 | 8.82 | 8.82 | 11.49 | 15.79 |
| Barium sulfate | 10 | 10 | 10 | 10 | 10 |
| Dicumyl peroxide | 0.6 | 0.6 | 0.6 | 0.6 | 0.6 |
| Diphenyl disulfide | 1.0 | 1.0 | 1.0 | 1.0 | 1.0 |
| Intermediate layer composition | | | | | |
| Surlyn 8945 *2 | 36 | — | 40 | 21 | 24 |
| Surlyn 9945 *3 | 36 | — | 40 | 21 | 24 |
| Septon HG-252 *4 | 28 | — | 20 | 58 | 52 |
| Elastoran ET880 *5 | — | 100 | — | — | — |
| Tungsten | 22.9 | — | 22.3 | 22.8 | 22.4 |

*1: High-cis Polybutadiene rubber (trade name "BR-11") available from JSR Co., Ltd. (Content of 1,4-cis-polybutadiene: 96%)
*2: Surlyn 8945 (trade name), ethylene-methacrylic acid copolymer ionomer resin obtained by neutralizing with sodium ion, manufactured by DuPont Co.
*3: Surlyn 9945 (trade name), ethylene-methacrylic acid copolymer ionomer resin obtained by neutralizing with zinc ion, manufactured by Dupont Co.
*4: Septon HG-252 (trade name), hydrogenated styrene-isoprene-styrene (SIS) block copolymer having a terminal OH group, manufactured by Kuraray Co. Ltd., content of styrene = about 40% by weight
*5: Polyurethane elastomer (trade name "Elastoran ET880") available from Takeda Verdishe Urethane Industries, Ltd.

Formation of Outer Layer

The compositions for the outer layer having the formulation shown in Tables 4 and 5 (Examples) and Table 6 (Comparative Examples) were injection molded on the intermediate layer to form the outer layer. The thickness, JIS-C hardness and specific gravity of the outer layer were measured. The results are shown in Tables 7 and 8 (Examples) and Table 9 (Comparative Examples).

Formation of Cover

The compositions for the cover having the formulation shown in Tables 4 and 5 (Examples) and Table 6 (Comparative Examples) were injection molded on the outer layer to form the cover. The thickness, JIS-C hardness and specific gravity of the cover were measured. The results are shown in Tables 7 and 8 (Examples) and Table 9 (Comparative Examples). Then, paint was applied on the cover, which is generally done on the surface of a golf ball, to produce four-piece solid golf balls. With respect to the resulting golf balls, the flight performance (launch angle, spin amount, flight distance) and shot feel were measured or evaluated. The results are shown in Tables 7 and 8 (Examples) and Table 9 (Comparative Examples). The test methods are as described later.

TABLE 4

(parts by weight)

| | Example No. | | | | | |
|---|---|---|---|---|---|---|
| | 1 | 2 | 3 | 4 | 5 | 6 |
| Outer layer composition | | | | | | |
| Hi-milan 1605 *6 | 60 | 60 | — | — | — | 60 |
| Hi-milan 1706 *7 | 40 | 40 | — | — | — | 401 |
| Hi-milan 1855 *8 | — | — | 10 | 10 | 10 | — |
| Surlyn 8945 *2 | — | — | 46 | 46 | 46 | — |
| Surlyn 9945 *3 | — | — | 37 | 37 | 37 | — |
| Pebax 2533S *9 | — | — | 5 | 5 | 5 | — |
| Epofriend A1010 *10 | — | — | 2 | 2 | 2 | — |
| Tungsten | 34.9 | 34.9 | 34.3 | 34.3 | 34.3 | 34.9 |
| Barium sulfate | — | — | — | — | — | — |
| Cover composition | | | | | | |
| Hi-milan 1605 *6 | 60 | 60 | — | — | — | 60 |
| Hi-milan 1706 *7 | 40 | 40 | — | — | — | 40 |
| Hi-milan 1855 *8 | — | — | 10 | 10 | 10 | — |
| Surlyn 8945 *2 | — | — | 46 | 46 | 46 | — |
| Surlyn 9945 *3 | — | — | 37 | 37 | 37 | — |
| Pebax 2533S *9 | — | — | 5 | 5 | 5 | — |
| Epofriend A1010 *10 | — | — | 2 | 2 | 2 | — |
| Barium sulfate | 3 | 3 | 2.5 | 2.5 | 2.5 | 3 |

TABLE 5

(parts by weight)

| | Example No. | | | | | |
|---|---|---|---|---|---|---|
| | 7 | 8 | 9 | 10 | 11 | 12 |
| Outer layer composition | | | | | | |
| Hi-milan 1605 *6 | — | — | 60 | — | 60 | — |
| Hi-milan 1706 *7 | — | — | 40 | — | 40 | — |
| Hi-milan 1855 *8 | 10 | 10 | — | — | — | — |
| Surlyn 8945 *2 | 46 | 46 | — | 44 | — | 40 |
| Surlyn 9945 *3 | 37 | 37 | — | 44 | — | 40 |
| Pebax 2533S *9 | 5 | 5 | — | — | — | — |
| Epofriend A1010 *10 | 2 | 2 | — | — | — | — |
| Septon HG-252 *4 | — | — | — | 12 | — | 20 |
| Tungsten | — | — | 14.5 | 33.2 | 34.9 | 33.8 |
| Barium sulfate | 2.5 | 2.5 | — | — | — | — |
| Cover composition | | | | | | |
| Hi-milan 1605 *6 | 60 | — | 60 | 60 | — | 60 |
| Hi-milan 1706 *7 | 40 | — | 40 | 40 | — | 40 |
| Hi-milan 1855 *8 | — | 10 | — | — | 10 | — |
| Surlyn 8945 *2 | — | 46 | — | — | 46 | — |
| Surlyn 9945 *3 | — | 37 | — | — | 37 | — |
| Pebax 2533S *9 | — | 5 | — | — | 5 | — |
| Epofriend A1010 *10 | — | 2 | — | — | 2 | — |
| Barium sulfate | 3 | 2.5 | 3 | 3 | 2.5 | 3 |

TABLE 6

(parts by weight)

| | Comparative Example No. | | | | |
|---|---|---|---|---|---|
| | 1 | 2 | 3 | 4 | 5 |
| Outer layer composition | | | | | |
| Hi-milan 1605 *6 | 60 | 60 | | | |
| Hi-milan 1706 *7 | 40 | 40 | | | |

TABLE 6-continued

| | Comparative Example No. (parts by weight) | | | | |
|---|---|---|---|---|---|
| | 1 | 2 | 3 | 4 | 5 |
| Hi-milan 1855 *8 | — | — | — | — | |
| Surlyn 8945 *2 | — | — | — | 36 | 41 |
| Surlyn 9945 *3 | — | — | — | 36 | 41 |
| Elastoran ET880 *5 | — | — | 100 | — | — |
| Pebax 2533S *9 | — | — | — | — | — |
| Epofriend A1010 *10 | — | — | — | — | — |
| Septon HG-252 *4 | — | — | — | 28 | 18 |
| Tungsten | 34.9 | 34.9 | 15.7 | 34.5 | 33.7 |
| Barium sulfate | — | — | — | — | — |
| Outer layer composition | | | | | |
| Hi-milan 1605 *6 | 60 | 60 | 60 | 60 | 60 |
| Hi-milan 1706 *7 | 40 | 40 | 40 | 40 | 40 |
| Hi-milan 1855 *8 | — | — | — | — | — |
| Surlyn 8945 *2 | — | — | — | — | — |
| Surlyn 9945 *3 | — | — | — | — | — |
| Pebax 2533S *9 | — | — | — | — | — |
| Epofriend A1010 *10 | — | — | — | — | — |
| Barium sulfate | 3 | 3 | 3 | 3 | 3 |

*6: Hi-milan 1605 (trade name), ethylene-methacrylic acid copolymer ionomer resin obtained by neutralizing with sodium ion, manufactured by Mitsui Du Pont Polychemical Co., Ltd.
*7: Hi-milan 1706 (trade name), ethylene-methacrylic acid copolymer ionomer resin obtained by neutralizing with zinc ion, manufactured by Mitsui Du Pont Polychemical Co., Ltd.
*8: Hi-milan 1855 (trade name), ethylene-methacrylic acid-isobutyl acrylate terpolymer ionomer resin obtained by neutralizing with zinc ion, manufactured by Mitsui Du Pont Polychemical Co., Ltd.
*9: Pebax 2533S (trade name), polyamide thermoplastic elastomer, manufactured by ELF Atochem Co.
*10: Epofriend AT1010 (trade name), styrene-butadiene-styrene (SBS) block copolymer with epoxy groups, manufactured by Daicel Chemical Industries, Ltd., JIS-A hardness = 67, styrene/butadiene (weight ratio) = 40/60, content of epoxy = about 1.5 to 1.7% by weight

Test Method

(A) JIS-C Hardness

(1) Hardness of the Core

After removing the cover, outer layer and intermediate layer from the resulting golf ball to expose the core, a surface hardness of the core is determined by measuring a hardness at the surface of the core. A center hardness of the core is determined by cutting the core into two equal parts and then measuring a JIS-C hardness at the center point of the section.

(2) Hardness of the Intermediate Layer

After removing the cover and outer layer from the resulting golf ball to expose the molded article which is the core covering with the intermediate layer, a hardness of the intermediate layer is determined by measuring a JIS-C hardness at the surface of the article.

(3) Hardness of the Outer Layer

After removing the cover from the resulting golf ball to expose the molded article which is the core covering with the intermediate layer and outer layer, a hardness of the outer layer is determined by measuring a JIS-C hardness at the surface of the article.

(4) Hardness of the Cover

After the molded article is obtained by covering the core with the intermediate layer, outer layer and cover, a hardness of the cover is determined by measuring a JIS-C hardness at the surface of the article.

In the hardness (1) to (4), the JIS-C hardness is measured by a JIS-C hardness meter according to JIS K 6301.

(B) Flight Performance

(1) Flight Performance 1

A No.1 wood club (W#1, a driver) having a metal head was mounted to a swing robot manufactured by True Temper Co. and the golf ball was hit at a head speed of 35 m/second, the launch angle, spin amount and flight distance were measured. The spin amount was measured by continuously taking a photograph of a mark provided on the hit golf ball using a high-speed camera. As the flight distance, carry that is a distance to the dropping point of the hit golf ball was measured.

(2) Flight Performance 2

A No.5 iron club (I#5) having a metal head was mounted to a swing robot manufactured by True Temper Co. and the golf ball was hit at a head speed of 30 m/second, the launch angle, spin amount and flight distance were measured as described in flight performance (1).

(C) Shot Feel

The shot feel of the golf ball is evaluated by 10 golfers according to a practical hitting test using a No. 1 wood club at a head speed of 35 m/second. The evaluation criteria are as follows.

Evaluation criteria:

○: Not less than 8 out of 10 golfers felt that the golf ball has small impact force and good shot feel.

Δ: Not less than 8 out of 10 golfers felt that the golf ball has fairly shot feel.

X: Not less than 8 out of 10 golfers felt that the golf ball has large impact force and good shot feel.

XW: Not less than 8 out of 10 golfers felt that the golf ball has heavy and poor shot feel.

TABLE 7

| | Example No. | | | | | |
|---|---|---|---|---|---|---|
| | 1 | 2 | 3 | 4 | 5 | 6 |
| (Core) | | | | | | |
| Diameter (mm) | 31.3 | 31.3 | 31.3 | 31.3 | 31.3 | 32.9 |
| JIS-C hardness | 67 | 70 | 75 | 80 | 75 | 75 |
| Specific gravity | 1.13 | 1.13 | 1.13 | 1.13 | 1.13 | 1.12 |
| (Intermediate layer) | | | | | | |
| Thickness (mm) | 1.9 | 1.9 | 1.9 | 1.9 | 1.9 | 1.9 |
| JIS-C hardness | 95 | 89 | 85 | 85 | 85 | 80 |
| Specific gravity | 1.13 | 1.13 | 1.13 | 1.13 | 1.13 | 1.12 |
| (Outer layer) | | | | | | |
| Thickness (mm) | 1.9 | 1.9 | 1.9 | 1.9 | 1.9 | 1.4 |
| JIS-C hardness | 100 | 100 | 97 | 97 | 97 | 100 |
| Specific gravity | 1.25 | 1.25 | 1.25 | 1.25 | 1.25 | 1.25 |
| (Cover) | | | | | | |
| Thickness (mm) | 1.9 | 1.9 | 1.9 | 1.9 | 1.9 | 1.6 |
| JIS-C hardness | 100 | 100 | 97 | 97 | 97 | 100 |

TABLE 7-continued

| | Example No. | | | | | |
|---|---|---|---|---|---|---|
| | 1 | 2 | 3 | 4 | 5 | 6 |
| Specific gravity (Golf ball) | 0.98 | 0.98 | 0.98 | 0.98 | 0.98 | 0.98 |
| Flight performance 1 (W#1, 35 m/sec) | | | | | | |
| Launch angle (degree) | 13.1 | 13.5 | 13.0 | 12.8 | 13.0 | 13.4 |
| Spin amount (rpm) | 2880 | 2850 | 2950 | 2960 | 2900 | 2810 |
| Carry (yard) | 161.9 | 162.1 | 161.3 | 161.0 | 161.5 | 161.8 |
| Flight performance 2 (I#5, 30 m/sec) | | | | | | |
| Launch angle (degree) | 17.3 | 17.1 | 17.3 | 17.2 | 17.6 | 17.5 |
| Spin amount (rpm) | 3480 | 3520 | 3450 | 3510 | 3420 | 3400 |
| Carry (yard) | 131.9 | 131.6 | 132.1 | 131.7 | 132.5 | 132.2 |
| Shot feel | ○ | ○ | ○ | ○ | ○ | ○ |

TABLE 8

| | Example No. | | | | | |
|---|---|---|---|---|---|---|
| | 7 | 8 | 9 | 10 | 11 | 12 |
| (Core) | | | | | | |
| Diameter (mm) | 31.3 | 31.3 | 31.3 | 31.3 | 31.3 | 31.3 |
| JIS-C hardness | 75 | 80 | 70 | 70 | 70 | 70 |
| Specific gravity | 1.22 | 1.22 | 1.19 | 1.13 | 1.13 | 1.13 |
| (Intermediate layer) | | | | | | |
| Thickness (mm) | 1.9 | 1.9 | 1.9 | 1.9 | 1.9 | 1.9 |
| JIS-C hardness | 85 | 85 | 89 | 89 | 89 | 89 |
| Specific gravity | 1.22 | 1.22 | 1.19 | 1.13 | 1.13 | 1.13 |
| (Outer layer) | | | | | | |
| Thickness (mm) | 1.9 | 1.9 | 1.9 | 1.9 | 1.9 | 1.9 |
| JIS-C hardness | 97 | 97 | 100 | 93 | 100 | 89 |
| Specific gravity | 0.98 | 0.98 | 1.08 | 1.25 | 1.25 | 1.25 |
| (Cover) | | | | | | |
| Thickness (mm) | 1.9 | 1.9 | 1.9 | 1.9 | 1.9 | 1.9 |
| JIS-C hardness | 100 | 97 | 100 | 100 | 97 | 100 |
| Specific gravity | 0.98 | 0.98 | 0.98 | 0.98 | 0.98 | 0.98 |
| (Golf ball) | | | | | | |
| Flight performance 1 (W#1, 35 m/sec) | | | | | | |
| Launch angle (degree) | 12.5 | 12.3 | 13.5 | 13.5 | 13.1 | 12.4 |
| Spin amount (rpm) | 2980 | 3010 | 2880 | 2810 | 2920 | 2980 |
| Carry (yard) | 160.5 | 160.0 | 161.8 | 162.0 | 161.8 | 159.8 |
| Flight performance 2 (I#5, 30 m/sec) | | | | | | |
| Launch angle (degree) | 16.4 | 16.3 | 17.1 | 17.1 | 16.8 | 16.3 |

TABLE 8-continued

| | Example No. | | | | | |
|---|---|---|---|---|---|---|
| | 7 | 8 | 9 | 10 | 11 | 12 |
| Spin amount (rpm) | 3580 | 3590 | 3590 | 3420 | 3580 | 3590 |
| Carry (yard) | 131.1 | 130.9 | 131.3 | 131.1 | 130.9 | 130.7 |
| Shot feel | ○ | ○ | ○ | ○ | ○ | ○ |

TABLE 9

| | Comparative Example No. | | | | |
|---|---|---|---|---|---|
| | 1 | 2 | 3 | 4 | 5 |
| (Core) | | | | | |
| Diameter (mm) | 31.3 | 31.3 | 31.3 | 31.3 | 31.3 |
| JIS-C hardness | 60 | 70 | 70 | 60 | 55 |
| Specific gravity | 1.13 | 1.13 | 1.13 | 1.13 | 1.13 |
| (Intermediate layer) | | | | | |
| Thickness (mm) | 1.9 | 1.9 | 1.9 | 1.9 | 1.9 |
| JIS-C hardness | 85 | 55 | 89 | 70 | 73 |
| Specific gravity | 1.13 | 1.13 | 1.13 | 1.13 | 1.13 |
| (Outer layer) | | | | | |
| Thickness (mm) | 1.9 | 1.9 | 1.9 | 1.9 | 1.9 |
| JIS-C hardness | 100 | 100 | 55 | 85 | 90 |
| Specific gravity | 1.25 | 1.25 | 1.25 | 1.25 | 1.25 |
| (Cover) | | | | | |
| Thickness (mm) | 1.9 | 1.9 | 1.9 | 1.9 | 1.9 |
| JIS-C hardness | 100 | 100 | 100 | 100 | 100 |
| Specific gravity | 0.98 | 0.98 | 0.98 | 0.98 | 0.98 |
| (Golf ball) | | | | | |
| Flight performance 1 (W#1, 35 m/sec) | | | | | |
| Launch angle (degree) | 13.0 | 12.2 | 12.0 | 13.0 | 13.0 |
| Spin amount (rpm) | 2910 | 3090 | 3120 | 2860 | 2840 |
| Carry (yard) | 157.5 | 159.0 | 158.9 | 156.5 | 156.0 |
| Flight performance 2 (I#5, 30 m/sec) | | | | | |
| Launch angle (degree) | 17.2 | 16.3 | 15.9 | 17.3 | 17.4 |
| Spin amount (rpm) | 3410 | 3640 | 3710 | 3200 | 3180 |
| Carry (yard) | 127.5 | 129.5 | 128.9 | 125.0 | 123.4 |
| Shot feel | XW | Δ | Δ | XW | XW |

As is apparent from Tables 7 to 9, the four-piece solid golf balls of Examples 1 to 12 of the present invention had excellent shot feel even at the time of hitting at a low head speed, which is 35 m/second, and longer flight distance when hit by a driver and No.5 iron club, than the conventional golf balls of Comparative Examples 1 to 5.

On the other hand, in the golf ball of Comparative Example 1, the deformation amount at the time of hitting is too large, and the rebound characteristics are degraded, which reduces flight distance, because the surface hardness of the core is low.

In the golf ball of Comparative Example 2, since the hardness of the intermediate layer is not more than the surface hardness of the core, the golf ball does not deforms at all portion thereof, but it deforms only at a portion thereof. Therefore, the restoring force is small and the launch angle is small, which reduces flight distance.

In the golf ball of Comparative Example 3, since the hardness of the outer layer is not more than that of the intermediate layer, the golf ball does not deforms at all portion thereof, but it deforms only at a portion thereof. Therefore, the restoring force is small and the launch angle is small, which reduces flight distance. In addition, the hardness of the outer layer is too low, and the rebound characteristics are degraded, which reduces flight distance. Furthermore, since the hardness difference between the outer layer and intermediate layer is large, the layer having the highest hardness can not be thickly placed at an outer portion of the golf ball, and the shot feel is poor.

In the golf balls of Comparative Examples 4 and 5, the deformation amount at the time of hitting is too large, and the rebound characteristics are degraded, which reduces flight distance, because the surface hardness of the core is low. In addition, since the hardness of the intermediate layer is low and the area from the core and the intermediate layer, the deformation amount is too large. Furthermore, since the hardness difference between the cover and the outer layer is large, the layer having the highest hardness can not be thickly placed at an outer portion of the golf ball, and the shot feel is heavy and poor.

What is claimed is:

1. A four-piece solid golf ball comprising a core, and intermediate layer formed on the core, an outer layer formed on the intermediate layer and a cover covering the outer layer, wherein the core has a surface hardness in JIS-C hardness of 67 to 85, the intermediate layer has a JIS-C hardness of 80 to 95, the outer layer has a JIS-C hardness of 88 to 100, the cover has a JIS-C hardness of 85 to 100, the JIS-C hardness of the intermediate layer is higher than the surface hardness of the core, the JIS-C hardness of the outer layer is higher than the hardness of the intermediate layer, subtraction of the JIS-C hardness of the cover from that of the outer layer is −10 to 5, and the difference between the JIS-C hardness of the intermediate layer and that of the cover is 5 to 20.

2. The golf ball according to claim 1, wherein a specific gravity of the outer layer is different from that of the cover.

3. The golf ball according to claim 1, wherein the specific gravity of the outer layer is higher than that of the cover by more than 0.1.

4. The golf ball according to claim 1, wherein the JIS-C hardness of the outer layer is the same as that of the cover.

* * * * *